United States Patent [19]

Willeke

[11] Patent Number: 4,942,753

[45] Date of Patent: Jul. 24, 1990

[54] PROCESS AND APPARATUS FOR ROLLING STRUCTURAL SHAPES

[75] Inventor: Horst Willeke, Salzgitter, Fed. Rep. of Germany

[73] Assignee: Salzgitter AG, Berlin, Fed. Rep. of Germany

[21] Appl. No.: 311,608

[22] Filed: Feb. 15, 1989

[30] Foreign Application Priority Data

Feb. 17, 1988 [DE] Fed. Rep. of Germany ..... 3805364

[51] Int. Cl.[5] ..... B21B 1/12

[52] U.S. Cl. ..... 72/178; 72/224; 72/234

[58] Field of Search ..... 72/234, 235, 224, 225, 72/178, 226

[56] References Cited

U.S. PATENT DOCUMENTS

| | | | |
|---|---|---|---|
| 1,385,644 | 7/1921 | Roberts | 72/235 |
| 1,812,246 | 6/1931 | Oberg | 72/178 |
| 1,856,269 | 5/1932 | Schulz et al. | 72/224 |

FOREIGN PATENT DOCUMENTS

| | | | |
|---|---|---|---|
| 240433 | 11/1911 | Fed. Rep. of Germany . | |
| 254977 | 12/1912 | Fed. Rep. of Germany . | |
| 307856 | 9/1918 | Fed. Rep. of Germany . | |
| 2936680 | 3/1980 | Fed. Rep. of Germany . | |
| 3521949 | 1/1986 | Fed. Rep. of Germany . | |
| 1097 | 1/1972 | Japan | 72/234 |
| 135705 | 8/1983 | Japan | 72/225 |
| 74708 | 4/1986 | Japan | 72/224 |
| 283401 | 12/1986 | Japan | 72/224 |
| 282707 | 12/1987 | Japan | 72/224 |
| 599863 | 3/1978 | U.S.S.R. | 72/234 |

OTHER PUBLICATIONS

"Die Technik des Eisenhuttenwesens", 5th Edition, 1944, Verlag Stahleisen Dusseldorf, pp. 177–178.

"Hutte, Taschenbuch fur Eisenhuttenleute", 5th Edition, 1961, Verlag von Wilhelm Ernst & Sohn, Berlin, pp. 762–768 and pp. 922–925.

*Primary Examiner*—Daniel C. Crane

*Attorney, Agent, or Firm*—Thomas N. Ljungman

[57] ABSTRACT

In the fabrication of H-piles, I-beams, channels, tees, angles, double-tee structural shapes and similar rolling stock, a first structural shape segment or web is joined to at least one second structural shape segment or flange which may be bent outwardly. After the edging passes, during finishing, the flange or flanges are bent inwardly when the shape or stock is subjected to a final bending pass. A new bending method uses the principle of a three-roll bending process. An alternative bending solution includes a bending process with backup rolls for the first structural shape segment or web which do not touch the inner surfaces of the flanges or second structural shape segments.

26 Claims, 3 Drawing Sheets

PROCESS AND APPARATUS FOR ROLLING STRUCTURAL SHAPES

BACKGROUND OF THE INVENTION

1. Field of the Invention

This invention relates to a process for rolling structural shapes and to a rolling stand and a rolling mill for rolling the structural shapes according to the preferred process.

2. Description of the Prior Art

It is not uncommon for various structural shapes to be transformed from billets, ingots or slabs in several working stages and passes and finished to their final size. For decades, the processes described by Grey, Sack or Puppe ("Die Technik des Eisenhüttenwesens", 5th Edition, 1944, Verlag Stahleisen D sseldorf, pp. 177, 178) have been used on universal rolling mills.

The Grey rolling mill, with two rolling stands arranged one behind the other, is still used today in rolling trains for H-piles, I-beams or double-tee structural shapes with dimensions up to 1000 mm, since additional stands would involve enormous tool costs. The horizontal rolls work the web and the flanges simultaneously, while two vertical rolls finish the outside of the flanges.

In the Puppe process, disclosed in German Pat. Nos. 254,977 and 307,856, the flanges are rolled in a somewhat outwardly-bent position and then bent back into their final position. This process is also used for rolling on finishing mills, for example, in the fabrication of smaller H-piles, I-beams, double-tee structural shapes or beams, or channels, tees or angles ("Hütte, Taschenbuch für Eisenhüttenleute", 5th Edition, 1961, page 767, Verlag von Wilhelm Ernst & Sohn, Berlin). The process could also be used for shapes which, as a result of a notched configuration or undercutting of the structural shape, do not permit a direct fabrication process (German Pat. No. 240,433).

It does not appear that any significant improvements have heretofore been made to the Puppe principle. Quite modern rolling mills with modified technologies are disclosed in German Laid Open Pat. Nos. 29 36 680 and 35 21 949 and in U.S. Pat. Nos. 4,329,045 and 4,367,642. Such modern rolling mills use the principle of bending the flanges outwardly to prevent an offsetting of the web center on symmetrical shapes by bi-axial guidance of the structural shape.

The outward bending has the additional advantage of keeping the depth of indentation in the shaping roll low. As a result, the roll can be refinished more frequently and can be designed for a longer service life.

Both the Grey process and the Puppe process suffer from a serious disadvantage in the fabrication of beams with parallel flanges. The advantage of the Grey process, including its requirement for only a few rolls, is partly offset by the major friction wear to the shaping rolls because of the high relative speeds between the flange of the shapes and the shaping surfaces of the rolls. Additionally, the number of refinishings which can be performed on the roll is limited by the deeply indented shape, since the rolls must have a diameter within a specified range.

In the Puppe process for beams, and in fabrication processes for other structural shapes, this friction wear is significantly lower. However, at least one complete finishing stand must be installed for the final inward bending (final bending pass) of the outer shape segments.

Because of the reversing operation of the edging stand, the conventional finishing stand must be located at a distance of more than one length of rolling stock behind the final upsetting stand. As a result, such a rolling mill takes up a great deal of space.

All of the patents and publications mentioned above are incorporated herein by reference as if the entire contents thereof were fully set forth herein.

OBJECT OF THE INVENTION

It is therefore an object of the invention to create a simpler configuration for finishing, in particular for the final bending pass, on structural shapes.

It is another object of the invention to reduce the time and expense required for grooved/shaping rolls.

It is a further object of the invention to reduce the wear involved and the space required for rolling mills for structural shapes.

SUMMARY OF THE INVENTION

The process according to the invention makes possible a final bending pass appropriate to the material involved on structural shapes after the final edging. The process can be integrated online into a rolling train and can be used both in continuous rolling mills and in reversing rolling mills for the final, non-edging shaping of structural shapes. Since there are no relative speeds occurring between the tool in the form of a finishing roll and the rolling stock, tool wear is reduced to a minimum.

In such a process, rolls which are essentially cylindrical are used so that shapes of different widths can be subjected to a final bending pass. Consequently, less finishing rolls must be kept on hand.

There are two primary embodiments of the invention. The invention is characterized by the fact that the first shape segment, such as the web for an H-pile, is not formed by edging or buckling or bending. The first shape segment loses its dimensional stability, because it does not need to undergo any significant deformation. At the same time, the "idle stroke" of the prior art, including the incomplete bending of the second shape segment or flange in the region of the transition between the shape segments, can be avoided. The preferred process is facilitated by the outward bending of only a portion of the shape segment to be subjected to a final bending pass.

The preferred embodiment of the invention includes means for supporting the first shape segments during the final bending pass. This makes possible the use of a conventional universal rolling stand without requiring a new set of rolls. The top and bottom rolls, used, for example, in the production of H-piles, are merely replaced by narrower top and bottom rolls of the next-smaller shape height, which do not touch the flange. This solution produces surprising results for the final bending pass of large structural shapes, which had previously caused significant wear to the rolls. The adjacent second shape segments, which are to be bent into a plane for rolling, can be shaped with one compression roll.

Shape segments which are to be bent symmetrically should be finished simultaneously. As a result, during the finish rolling of H-piles, I-beams, channels and double-tee structural shapes with the same flange geometry, there is an equilibrium of forces between the three-roll bending systems located on both sides of the shape.

In theory, for the final bending pass with the three-roll bending process, at least one compression roll with a counter-roll ahead and a counter-roll behind is required for each shape segment to be finished. The backup rolls can be kept very small, since they only need to absorb the reaction forces. The shafts of the backup rolls can be rigidly aligned with the structural shape to be rolled. On the other hand, the compression roll is designed so that it can be adjusted as a function of the material to be rolled including the shape, thickness and the bending angle. In contrast to a hot-rolling process with very tight tolerances, compensation can therefore be provided for an elastic spring action which occurs during the inward bending.

This would be true for both preferred embodiments of the rolling stand according to the invention, for three-roll bending stands and for stands with top and bottom backup rolls for the first shape segments.

The process requires that the compression roll must be located on the outward side of the shape toward which the shape segments to be finished are initially bent. For structural shapes, which are generally symmetrical, it is therefore recommended that neighboring shape segments be bent inwardly with a compression roll.

While the backup rolls in three-roll bending stands absorb the reaction forces almost directly, on rolling stands with top and bottom rolls, the web must absorb the compression rolling forces. By supporting the first shape segment or web in its narrowest cross section, such as directly behind the transition radius from the first to the second shape segment or flange, excessive buckling stress is avoided.

Because the thrust resistances which occur during the process according to the invention are relatively low due to a lack of friction on the roll flanks, the thrust drive for the structural shape can also be kept small. According to the invention, such a drive can be coupled to the compression roll. However, if there is insufficient space, because of the roll adjustment equipment, for example, one or more of the backup rolls can also be equipped with a traction or thrust drive.

On rolling mills, according to the invention, the three-roll bending stand can be located immediately behind the final edging rolls. On reversing rolling mills, the three-roll bending stand following the penultimate edging pass is pivoted from an at rest position to a working position into the rolling plane.

Because of forward and reverse slipping of the material during an edging pass and the problems that can result in controlling the speed of the subsequent stand, the finishing stands for the bending of the structural shapes were previously located one rolling stock length behind the final edging stand. The preferred process makes possible a final bending pass which does not require its own drive since the necessary forward thrust of the structural shape can be provided by the final edging stand.

Only the end of the structural shape, after it leaves the edging stand, need be directly transported to the three-roll bending stand by a drive which can be turned on and off or by a separate driver. The preferred embodiments make it possible to shorten rolling mills by one rolling stock length.

A preferred process of the invention is for finishing an overall shape. The overall shape has at least a first shape segment and at least a second shape segment which are joined at an approximately right angle junction therebetween. The process includes the steps of roughing the first and the second shape segments to final dimensions with the second shape segment including at least a portion thereof being outwardly bent with respect to a remainder of the second shape segment and the junction: bending the portion of the second shape segment to be aligned with the remainder of the second shape segment and oriented at a right angle with respect to the first shape segment; the bending including directing a compression roll inwardly against the portion; and supporting at least one of the first shape segment and the second shape segment with additional rolls during the bending to prevent undesired bending thereof away from the overall shape.

A preferred rolling stand for converting a rough shape into an overall shape includes at least a first shape segment and at least a second shape segment which are joined at an approximate right angle junction therebetween. The rough shape includes the first and second shape segments having final dimensions with the second shape segment including at least a portion thereof being outwardly bent with respect to a remainder of the second shape segment and the junction. The rolling stand includes devices for bending the portion of the second shape segment for alignment with the remainder of the second shape segment for orientation at a right angle with respect to the first shape segment. The devices for bending include compression rolls directed inwardly against the portion. The devices for bending also include support elements for at least one of the first shape segment and second shape segment. The support elements include additional rolls for preventing undesired bending of the first shape segment and the second shape segment away from the overall shape.

A preferred rolling mill for providing overall shapes includes at least a first shape segment and at least a second shape segment which are joined at an approximate right angle junction therebetween. The rolling mill includes at least one stand for rolling the first and the second shape segments to a final size with at least a portion of the second shape segment being outwardly bent with respect to a remainder of the second shape segment. The rolling mill comprises at least a three-roll bending stand for receiving the overall shape from the one stand. The bending stand includes at least one compression roll directed inwardly for bending the portion for alignment with the remainder of the second shape segment for an orientation at a right angle with respect to the first shape segment. The bending stand includes at least a pair of support rolls for supporting at least one of the first shape segment and the second shape segment during the bending by the at least one compression roll.

The invention is explained in greater detail below, with reference to the accompanying drawings.

DESCRIPTION OF THE PREFERRED EMBODIMENTS

Figure 1:
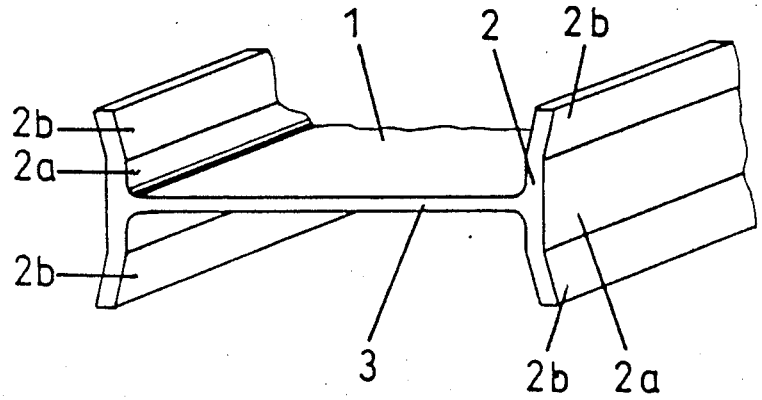
FIG. 1 is a fragmentary perspective view of one end of a double tee shape with flanges bent outward including various features of the invention.

As seen in FIG. 1, a double tee structural shape 1 is about 500 mm high with a web 3 which is about 15 mm thick and flanges 2 which are about 28 mm thick. The structural shape 1 was rolled in a reversing operation in a final edging stand of a rolling mill (not shown) to a nominal flange width of about 300 mm. To prevent the center of the web from being offset during the reversing operations, the flange segments 2*b* were bent outwardly. As a result, the side rolls of the edging stand are provided a convex rolling profile, which is complementary to the flange segments 2*a*, 2*b*, in order to guide the shape or profile 1 axially during the rolling process. With the contour shown in FIG. 1, the structural shape 1 is capable of being transported to the preferred three-roll bending stand as shown in FIG. 2.

Figure 2:
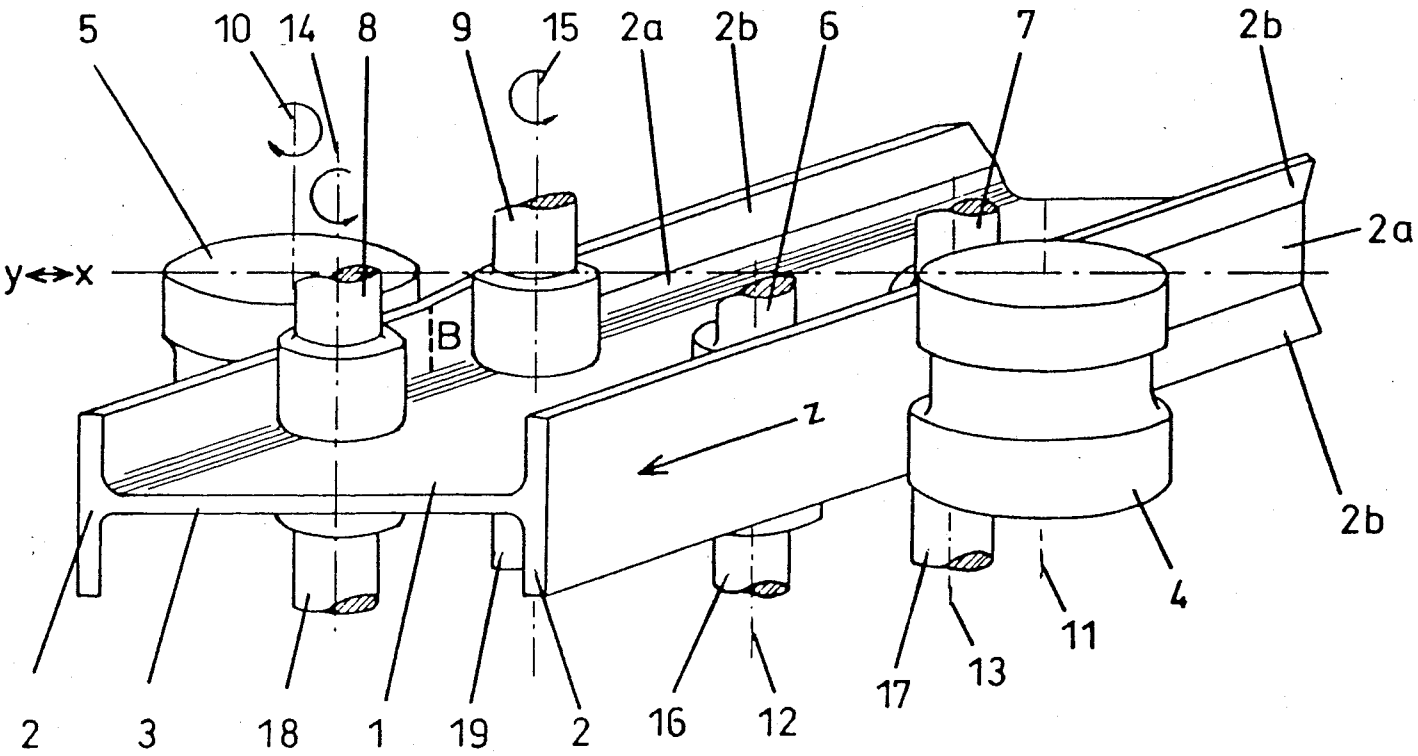
FIG. 2 is a perspective view of a three-roll bending stand according to the invention for the execution of the preferred process on flanges of a double tee beam of the type shown in FIG. 1.

As seen in FIG. 2, the preferred stand includes the structural shape 1 being moved in a rolling direction Z. In a transverse or lateral direction X-Y, which is perpendicular to the rolling direction Z, on both outer sides of the structural shape 1, there is preferably provided a pair of essentially cylindrical compression rolls 4, 5. The compression rolls 4, 5 respectively include rotational axes 11, 10 which are perpendicular to the rolling direction Z and to the lateral direction X-Y. Both compression rolls 4, 5 are preferably equipped with commercially available electric drive units (not shown), which respectively drive or rotate the compression rolls 4, 5 (as shown for roll 5 about the axis 10) and respectively cause lateral or transverse advancement of the compression rolls 4, 5 in the direction X or Y.

At one side of the structural shape 1, there are two pairs of cylindrical backup rolls 6, 16 and 7, 17 with rigidly aligned shafts 12 and 13 respectively. The rolls 7 and 17 are located ahead of the compression roll 4 in the rolling direction Z while the rolls 6 and 16 are located behind the compression roll 4 in the rolling direction Z. These backup rolls 6, 16 and 7, 17 tend to back up or support the inside of the flange segments 2*a* and to shape the inside of the flange segments 2*b* bent inwardly by the compression roll 4. On the opposite side of the structure shape 1, there is a symmetrically configured three-roll bending stand with the compression roll 5 and the backup rolls 8, 18 and 9, 19 respectively on the rigid shafts 14 and 15. The perspective view of FIG. 2 clearly shows the process of final bending the flange segment 2*b* in the bending line B between the three rolls 5, 8, 9. The finish-rolled double-tee structural shape 1 has straight, parallel flanges 2.

Figure 3:
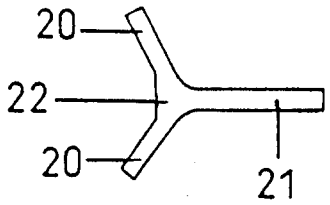
FIG. 3 is an end view of a tee with flanges bent outward.

FIG. 3 shows a tee structural shape with a web 21, whose flange segments 20 are bent outwardly, symmetrically of the web 21, so that during rolling, the web 21 is shaped axially. The flange segments 20 can be subjected to a preferred final bending pass with a three-roll bending stand, which is similar to those shown in FIG. 2.

In all such cases, an incomplete inward bending or idle stroke of the web/flange transition is impossible, since the segments 2*a* and 22 of the structural shape were not bent outwardly. However, it should be noted that the process is not limited to symmetrical structural shapes. In an analogous manner, different angles or channels with equal or unequal legs can also be finished in a similar rolling stand.

The preferred type of rolling stand is not limited to a three-roll bending stand. If necessary, for example, a double system with two bending lines can be provided by means of two compression rolls and three backup rolls. However, the principle of the three-roll bending process would still be retained.

Shape segments which are to be bent symmetrically should be finished simultaneously. As a result, during the finish rolling of H-piles, I-beams, channels and double-tee structural shapes with the same flange geometry, there is an equilibrium of forces between the three-roll bending systems located on both sides of the shape.

In theory, for the final bending pass with the three-roll bending process, at least one compression roll with a counter-roll ahead and a counter-roll behind is required for each shape segment to be finished. The backup rolls can be kept very small, since they only need to absorb the reaction forces. The shafts of the backup rolls can be rigidly aligned with the structural shape to be rolled. On the other hand, the compression roll is designed so that it can be adjusted as a function of the material to be rolled including the shape, thickness and the bending angle. In contrast to a hot-rolling process with very tight tolerances, compensation can therefore be provided for an elastic spring action which occurs during the inward bending.

Figure 4:
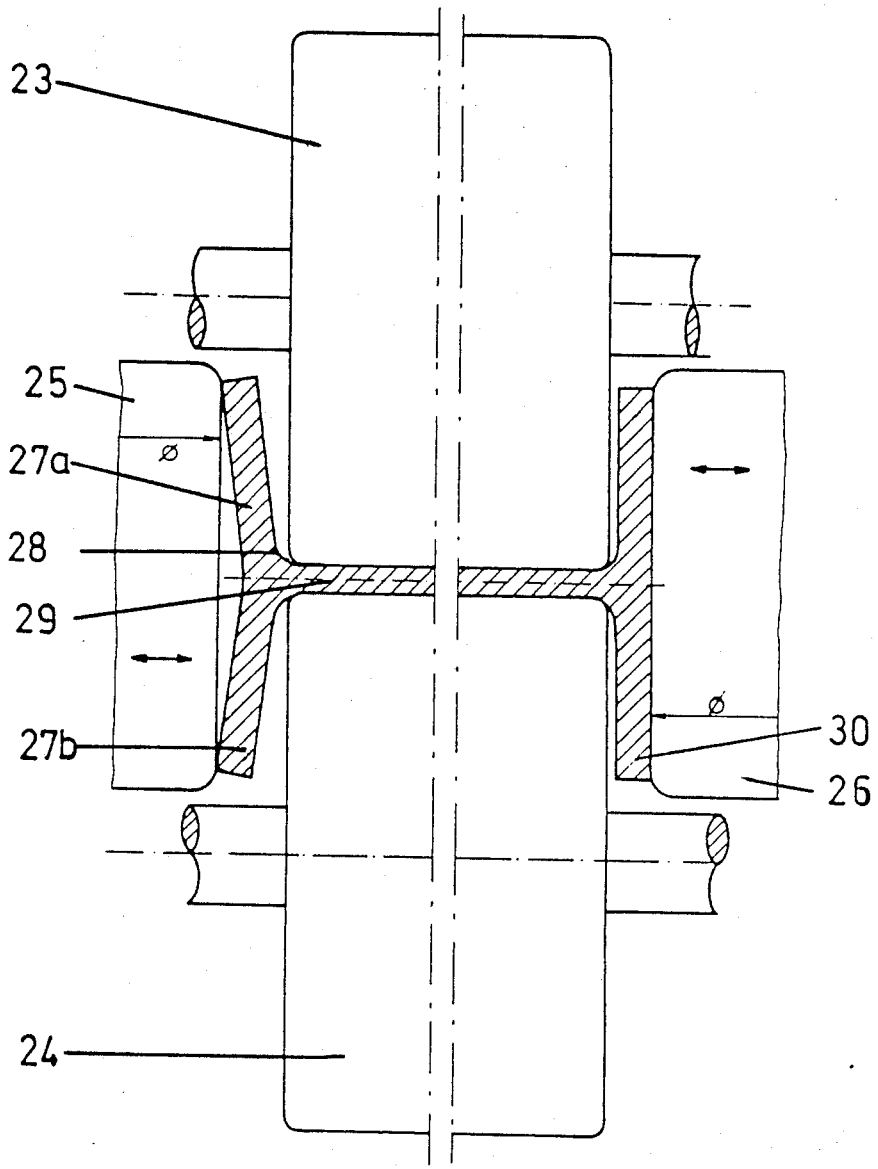
FIG. 4 is a fragmentary, sectional view of a rolling stand according to the invention including compression rolls and top and bottom backup rolls.

Another preferred type of solution to the same problem is illustrated in FIG. 4. A wide-flange beam, which is about 900 mm high, includes parallel flange surfaces with a flange width of about 300 mm, a web thickness of about 20 mm and a flange thickness of about 35 mm. The beam is preferably hot rolled with the flanges 27*a*, 27*b* bent outwardly to the above-mentioned nominal dimensions and form. In the preferred finishing stand with a pair of compression rolls 25, 26, a top roll 23 and a bottom roll 24, the structural shape segments 27*a*, 27*b* are bent inwardly by advancing the driven compression roll 25 inwardly toward the segments as shown at the left of FIG. 4. The finished structural shape with a straight flange 30 is shown (not to scale) at the right half of FIG. 4.

To prevent the compression roll forces from buckling the web 29, a web/flange radius 28 of about 30 mm is left free, and the web 29 is supported by the top roll 23 and the bottom roll 24. Since there is no contact with the inner flange surfaces, no abrasion can occur on the backup rolls 23, 24. The preferred invention also includes the use of very narrow backup rolls 23, 24 with a variable diameter. Such backup rolls 23, 24 laterally support the first structural shape segment or web 29 only over a very small width and do not contact the web 29 in its central region. The backup rolls 23, 24 may include rolling profiles with concave and/or convex regions to provide the desired localized contact with the web 29.

This embodiment of the invention includes means for supporting the first shape segments during the final bending pass. This makes possible the use of a conventional universal rolling stand without requiring a new set of rolls. The top and bottom rolls, used, for example, in the production of H-piles, are merely replaced by narrower top and bottom rolls of the next-smaller shape height or width, which do not touch the flange. This solution produces surprising results for the final bending pass of large structural shapes, which had previously caused significant wear to the rolls. The adjacent second shape segments, which are to be bent into a plane for rolling, can be shaped with one compression roll.

While the backup rolls in three-roll bending stands absorb the reaction forces almost directly, on rolling stands with top and bottom rolls, the web must absorb the compression rolling forces. By supporting the first shape segment or web in its narrowest cross section, such as directly behind the transition radius from the first to the second shape segment or flange, excessive buckling stress is avoided.

Because the thrust resistances which occur during the preferred processes are relatively low due to a lack of friction on the roll flanks, the thrust drive for the structural shape can also be kept small. According to the invention, such a drive can be coupled to the compression roll. However, if there is insufficient space, because of the roll adjustment equipment, for example, one or more of the backup rolls can also be equipped with a traction or thrust drive.

On rolling mills, the three-roll bending stand can be located immediately behind the final edging rolls. On reversing rolling mills, the three-roll bending stand following the penultimate edging pass is pivoted from an at rest position into the rolling plane.

Because of forward and reverse slipping of the material during an edging pass and the problems that can result in controlling the speed of the subsequent stand, the finishing stands for the bending of the structural shapes were previously located one rolling stock length behind the final edging stand. The preferred process makes possible a final bending pass which does not require its own drive since the necessary forward thrust of the structural shape can be provided by the final edging stand.

Only the end of the structural shape, after it leaves the edging stand, need be directly transported to the three-roll bending stand by a drive which can be turned on and off or by a separate driver. The preferred embodiments make it possible to shorten rolling mills by one rolling stock length.

In the preferred process, rolls which are essentially cylindrical are used so that shapes of different widths can be subjected to a final bending pass. Consequently, less finishing rolls must be kept on hand.

The present invention includes a process for the finishing of an overall shape with at least a first shape segment and a second shape segment oriented at an approximately right angle to the first shape segment. The process includes roughing to the final dimensions of the individual shape segments and subsequent final bending of the second shape segments, and is characterized by the fact that during the roughing, only parts **2*b*, 20, 27 of the second shape segments 2, 20, 22, 27 are bent outward with the second shape segments 2, 20** being finished by bending and straightening in the three-roll bending process.

Still further, the preferred process is for the finishing of the overall shape with at least one second shape segment oriented at approximately right angles to a first shape segment by roughing to the final dimensions of the individual shape segments. A subsequent final bending pass of the second shape segment is characterized by the fact that during the final bending of a portion **2*b*, 20, 27 or all of the second shape segment 2, 20, 22, 27, the first shape segment 3, 21, 29 is supported to prevent upsetting and buckling at a distance from the second shape segment 2, 20, 22, 27, 30. The distance is about 0.1 to about 4 times, and preferably about 0.5 to about 2 times, the thickness of the first shape segment 3, 21, 29**.

The preferred process for the finishing of structural shapes can be characterized by the fact that simultaneously, two second shape segments **2*b*, 20, 27 are subjected to a final bending in opposite directions in a plane. The second shape segments 2*b*, 20, 27 can be oriented symmetrically on H-piles, I-beams, channels and double-tee shapes 1** which are subjected to a final bending pass as they are bent symmetrically and simultaneously.

A preferred rolling stand for the execution of the process includes axes of the engaged finish bending rolls oriented parallel to one another. The preferred rolls 8, 9, 5: 18, 19, 5; 6, 7, 4; 16, 17, 4 guide each second shape segment 2. At least two of the rolls on one side of the second shape segment 2 are designed as rigid backup rolls 8,9; 18, 19; 6, 7; 16, 17 of the adjustable compression rolls 4, 5 which are located on the other side of the second shape segment 2 between the backup rolls.

The preferred rolling stand for the execution of the process can include the shafts of the finish bending rolls oriented parallel to one another. The backup rolls can be simultaneously engaged with the finish bending rolls for the first shape segment. The backup rolls 23, 24 may be narrower than the first shape segments 21, 29.

Generally, the preferred rolling stand can be characterized by the fact that the compression rolls 4, 5, 25, 26 are designed for each of two neighboring shape segments 2, 20, 27, 30 which are respectively subjected to a final bending in opposite directions. At least one of the rolls, preferably the compression roll 4, 5, 25, 26 has a drive.

A preferred rolling mill for the execution of the process includes a roughing train and at least one universal stand for rolling the shape segments to the final size. Immediately following the last edging roll there is a three-roll bending stand 8, 9, 5; 18, 19, 5; 6, 7, 4; 16, 17, 4. The preferred three-roll bending stand is mounted directly on an upright of the final stand. Additionally, the three-roll bending stand can be moved from an idle position into a working position.

A number of patents, such as U.S. Pat. Nos. 1,086,789; 2,174,195; 3,857,268; 4,184,353; and 4,440,012, disclose rolling methods and/or rolling mills. All of the patents cited above are incorporated herein by reference as if the entire contents thereof were fully set forth herein.

The invention as described hereinabove in the context of a preferred embodiment is not to be taken as limited to all of the provided details thereof, since modifications and variations thereof may be made without departing from the spirit and scope of the invention.

What is claimed is:

1. Process for finishing an overall shape, said overall shape having at least a first shape segment and at least a second shape segment which are joined at an approximately right angle junction therebetween, said process comprising the steps of:

roughing said first and said second shape segments to final dimensions with said second shape segment including at least a portion thereof being outwardly bent with respect to a remainder of said second shape segment and said junction;

bending said at least a portion of said second shape segment to be aligned with said remainder of said second shape segment and oriented at a right angle with respect to said first shape segment;

said bending including directing compression roll means inwardly toward a section of said second shape segment and against said portion at said section without supporting an immediately opposite section of said second shape segment directly opposed to said compression roll means; and supporting at least one of said first shape segment and said second shape segment at locations remote from said section of said second shape segment with additional roll means during said bending to prevent undesired bending of said first shape segment and said second shape segment away from said overall shape.

2. Process according to claim 1, wherein said supporting includes positioning backup roll means at an inside surface of said second shape segment.

3. Process according to claim 2, wherein said positioning of said backup roll means includes at least two backup rolls being respectively disposed at each side of said bending and said compression roll means.

4. Process according to claim 3, wherein said positioning said at least two backup rolls includes absorbing reaction forces caused by said compression roll means during said bending.

5. Process according to claim 1, wherein said supporting includes positioning at least a pair of opposed roll means on opposite sides of said first shape segment at a region thereof adjacent said junction.

6. Process according to claim 5, wherein said positioning prevents upsetting and buckling of said first shape segment during said bending.

7. Process according to claim 5, wherein said positioning of said at least a pair of opposed roll means is at said region of said first shape segment which is located at a distance from said second shape segment and said distance is from about 0.1 to about 4 times a thickness of said first shape segment.

8. Process according to claim 7, wherein said distance is from about 0.2 to about 2 times said thickness.

9. Process according to claim 1, wherein said overall shape includes two of said second shape segments which are respectively at opposite ends of said first shape segment, said bending of each of said two second shape segments occur simultaneously with respective said compression roll means, and said directing of said compression roll means is in opposite directions in a common plane.

10. Process according to claim 9, wherein said directing includes rotating each of said compression roll means respectively about axes which are parallel.

11. Process according to claim 1, further including the step of driving said overall shape during said bending by driven rotation of at least one of said compression roll means and said additional roll means.

12. Process according to claim 1, further including the step of driving said overall shape during said roughing, said bending and said supporting by driving means independent of said compression roll means and said additional roll means.

13. A rolling stand for converting a rough shape into an overall shape including at least a first shape segment and at least a second shape segment which are joined at an approximate right angle junction therebetween, said rough shape including said first and said second shape segments having final dimensions with said second shape segment including at least a portion thereof being outwardly bent with respect to a remainder of said second shape segment and said junction, said rolling stand comprising:

means for bending said at least a portion of said second shape segment for alignment with said remainder of said second shape segment for orientation at a right angle with respect to said first shape segment;

said means for bending including compression roll means directed inwardly toward a section of said second shape section against said portion at said section;

said means for bending including support means for said second shape segment;

said support means including additional roll means for preventing undesired bending of said first shape segment and said second shape segment away from said overall shape and;

said additional roll means for contacting said second shape segment at locations remote from said section of said second shape segment wherein said additional roll means includes a pair of backup roll means at an inside surface of said second shape segment, and said pair of backup roll means are disposed respectively at each side of said compression roll means for said bending at a region therebetween so that an immediately opposite section of said second shape segment directly opposed to said compression roll means is unsupported.

14. The rolling stand according to claim 13, wherein said pair of backup roll means absorb reaction forces caused by said compression roll means during said bending.

15. The rolling stand according to claim 13, wherein said additional roll means includes at least a pair of opposed roll means on opposite sides of said first shape segment at least at a region thereof adjacent said junction.

16. The rolling stand according to claim 15, wherein said at least a pair of opposed roll means are for preventing upsetting and buckling of said first shape segment during said bending.

17. The rolling stand according to claim 15, wherein said rough shape and said overall shape include two of said second shape segments which are respectively at opposite ends of said first shape segment, said first shape segment has a length between said two second shape segments, and said at least a pair of opposed roll means have a width which is less than said length of said first shape segment.

18. The rolling stand according to claim 13, wherein said rough shape and said overall shape include two of said second shape segments which are respectively at opposite ends of said first shape segment, said compression roll means for said two second shape segments are for simultaneously bending respective said at least a portion of each of said two second shape segments, and said compression roll means are inwardly directed in opposite directions in a common plane.

19. The rolling stand according to claim 18, wherein said compression roll means include axes of rotation which are parallel.

20. The rolling stand according to claim 13, wherein at least one of said compression roll means and said additional roll means is driven for moving said rough shape and said overall shape through said rolling stand.

21. The rolling stand according to claim 13, wherein said compression roll means and said additional roll means include rolls for being non-driven.

22. A rolling mill for providing overall shapes including at least a first shape segment and at least a second shape segment which are joined at an approximate right angle junction therebetween, said rolling milling including at least one stand for rolling said first and said second shape segments to a final size with at least a portion of said second shape segment being outwardly bent with respect to a remainder of said second shape segment, said rolling mill comprising:

at least a three-roll bending stand for receiving said overall shape from said at least one stand;

said bending stand including at least one compression roll directed inwardly toward a section of second shape segment for bending said at least one portion for alignment with said remainder of said second shape segment for an orientation at a right angle with respect to said first shape segment; and said bending stand including at least a pair of support rolls for supporting said second shape segment at locations of said second shape segment, which said locations are remote from said section of said second shape segment, during said bending by said at least one compression roll wherein said pair of support rolls are at an inside surface of said second shape segment, and said pair of support rolls are disposed respectively at each side of said compression roll means for said bending at a region therebetween so that an immediately opposite section of said second shape segment directly opposed to said compression roll means is unsupported 23. The rolling mill according to claim 22, wherein said pair of support rolls are backup rolls at an inside surface of said second shape segment and said backup rolls are disposed respectively at each side of said compression roll for said bending therebetween.

24. The rolling mill according to claim 22, wherein said pair of support rolls are opposed rolls on opposite sides of said first shape segment at least at a region thereof adjacent said junction.

25. The rolling mill according to claim 22, wherein said three-roll bending stand can be selectively disposed at an idle position and at a working position relative to said at least one stand.

26. The rolling mill according to claim 22, wherein said at least one stand includes means for providing forward thrust to said overall shape to cause passage of said overall shape through said bending stand; and said at least one compression roll and said at least a pair support rolls comprise rolls for being non-driven.

* * * * *

UNITED STATES PATENT AND TRADEMARK OFFICE

CERTIFICATE OF CORRECTION

PATENT NO. : 4,942,753

DATED : July 24, 1990

INVENTOR(S) : Horst WILLEKE

It is certified that error appears in the above-identified patent and that said Letters Patent is hereby corrected as shown below:

On the title page, the Assignee section item [73], after 'Assignee:', please delete "Salzgitter AG, Berlin, Fed. Rep. of Germany", and insert --Stahlwerke Peine-Salzgitter AG, Peine, Fed. Rep. of Germany--.

Signed and Sealed this

Seventh Day of January, 1992

*Attest:*

*Attesting Officer*

HARRY F. MANBECK, JR.

*Commissioner of Patents and Trademarks*